US010443178B2

(12) United States Patent
Christensen et al.

(10) Patent No.: US 10,443,178 B2
(45) Date of Patent: Oct. 15, 2019

(54) REAR PANEL AND BASEMENT DAMPING TREATMENTS FOR A LAUNDRY APPLIANCE

(71) Applicant: WHIRLPOOL CORPORATION, Benton Harbor, MI (US)

(72) Inventors: Mark J. Christensen, Stevensville, MI (US); John G. Kantz, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 30 days.

(21) Appl. No.: 15/693,844

(22) Filed: Sep. 1, 2017

(65) Prior Publication Data

US 2019/0071812 A1 Mar. 7, 2019

(51) Int. Cl.

| | |
|---|---|
| ***D06F 37/20*** | (2006.01) |
| ***D06F 39/12*** | (2006.01) |
| ***D06F 37/26*** | (2006.01) |
| *D06F 58/20* | (2006.01) |

(52) U.S. Cl.

CPC ..... *D06F 37/20* (2013.01); *D06F 37/26* (2013.01); *D06F 39/12* (2013.01); *D06F 58/20* (2013.01)

(58) Field of Classification Search

CPC ..... A47L 15/4209; D06F 39/02; D06F 37/22; D06F 37/24; D06F 37/26; D06F 29/005; D06F 58/04; D06F 58/20; D06F 37/20; D06F 39/12

See application file for complete search history.

(56) References Cited

U.S. PATENT DOCUMENTS

| | | | | |
|---|---|---|---|---|
| 2,818,719 | A | 1/1958 | Cline | |
| 2,927,380 | A | 3/1960 | Olthuis | |
| 4,949,477 | A | 8/1990 | Geiger | |
| 5,965,851 | A * | 10/1999 | Herreman | B32B 5/26 181/200 |
| 7,981,222 | B2 * | 7/2011 | Colon | A47L 15/4209 134/200 |
| 8,844,163 | B2 | 9/2014 | Palazzin et al. | |
| 9,179,817 | B2 | 11/2015 | Fritz et al. | |
| 2005/0120585 | A1 * | 6/2005 | Lee | D06F 37/06 34/602 |
| 2006/0046594 | A1 | 3/2006 | Starrett | |
| 2006/0266385 | A1 | 11/2006 | Malaker | |
| 2007/0175907 | A1 | 8/2007 | Kempe et al. | |
| 2012/0298154 | A1 | 11/2012 | Rockwell et al. | |
| 2014/0230497 | A1 | 8/2014 | Rockwell et al. | |
| 2017/0145622 | A1 | 5/2017 | Lentz et al. | |

FOREIGN PATENT DOCUMENTS

| | | |
|---|---|---|
| CN | 105937147 | 9/2016 |
| JP | H02295592 | 12/1990 |
| JP | H049196 | 1/1992 |
| JP | 2003265982 | 9/2003 |
| WO | 0028127 | 5/2000 |

* cited by examiner

*Primary Examiner* — David G Cormier
(74) *Attorney, Agent, or Firm* — Price Heneveld LLP

(57) ABSTRACT

A laundry appliance includes a motor that operates a rotating drum for processing laundry. A rear wall of a cabinet is located behind the rotating drum. An interior wall is offset from the rear wall and defines a cavity. First and second insulating members are positioned in an offset configuration within the cavity.

14 Claims, 6 Drawing Sheets

REAR PANEL AND BASEMENT DAMPING TREATMENTS FOR A LAUNDRY APPLIANCE

FIELD OF THE DEVICE

The device is in the field of laundry appliances, and more specifically, a sound and vibration damping treatment disposed within a basement and near a rear wall for a laundry appliance.

SUMMARY

In at least one aspect, a laundry appliance includes a motor that operates a rotating drum for processing laundry. A rear wall of a cabinet is located behind the rotating drum. An interior wall is offset from the rear wall and defines a cavity. First and second insulating members are positioned in an offset configuration within the cavity.

In at least another aspect, a base pan and a rear panel are connected to partially form the appliance cabinet. A motor operates a rotating drum within the appliance cabinet. A first insulating member is attached to the rear wall. A second insulating member is attached to a vertical portion of the base pan. The first and second insulating members define a gap. The gap and the first and second insulating members cooperate to absorb vibrations generated by the rotating drum during operation of the motor.

A laundry appliance includes a base pan and a rear panel that are connected to partially form a cavity within an appliance cabinet. A motor operates a rotating drum within the appliance cabinet. First and second insulating members are positioned within the cavity and define a gap. An upper insulating member is positioned on the rear wall near the rotating drum. The upper insulating member and the first and second insulating members cooperate to absorb vibrations generated by the rotating drum during operation of the motor.

These and other features, advantages, and objects of the present device will be further understood and appreciated by those skilled in the art upon studying the following specification, claims, and appended drawings.

DETAILED DESCRIPTION OF EMBODIMENTS

Figure 1:
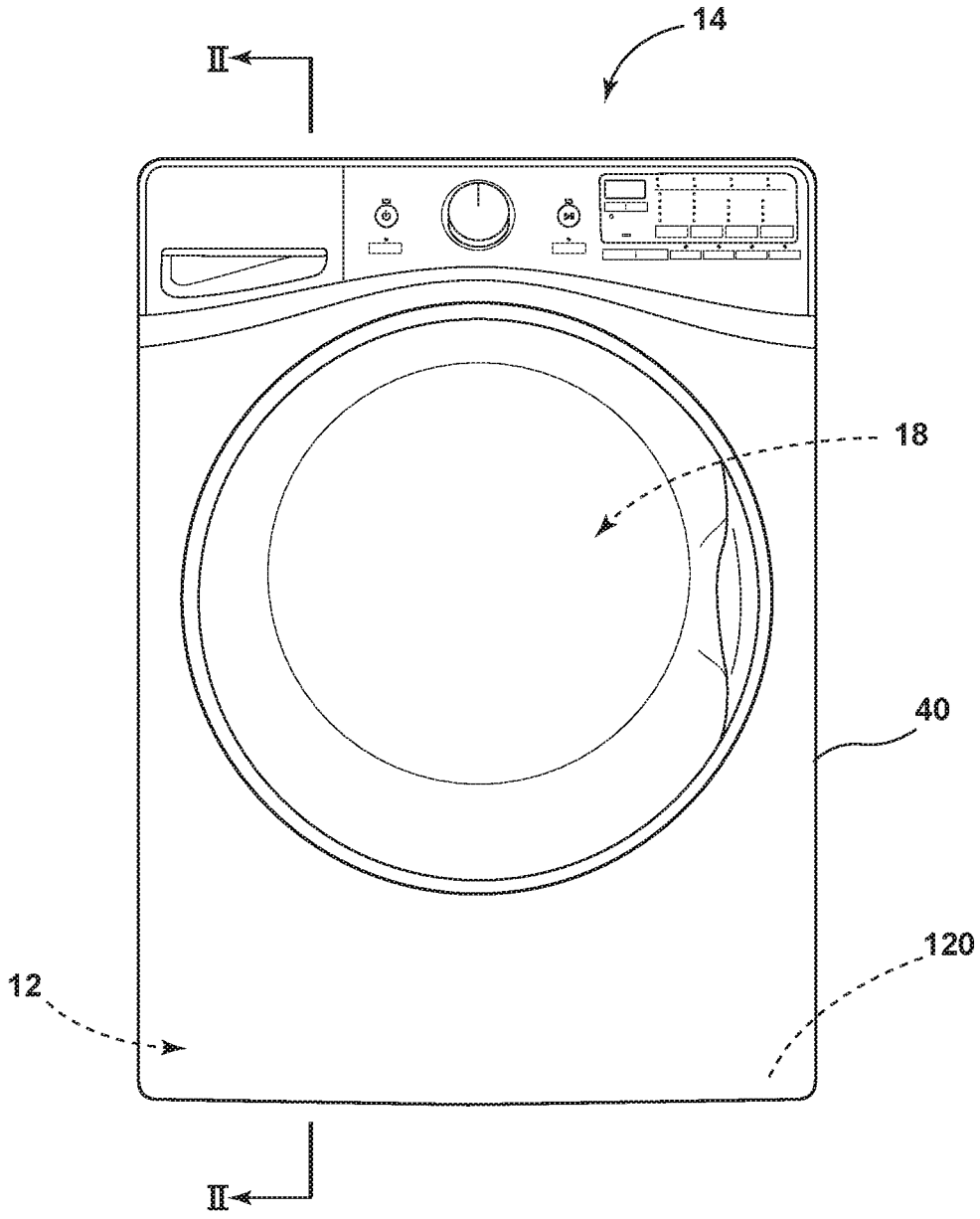
FIG. 1 is a front elevational view of a laundry appliance incorporating an aspect of a vibration damping structure therein.
Figure 2:
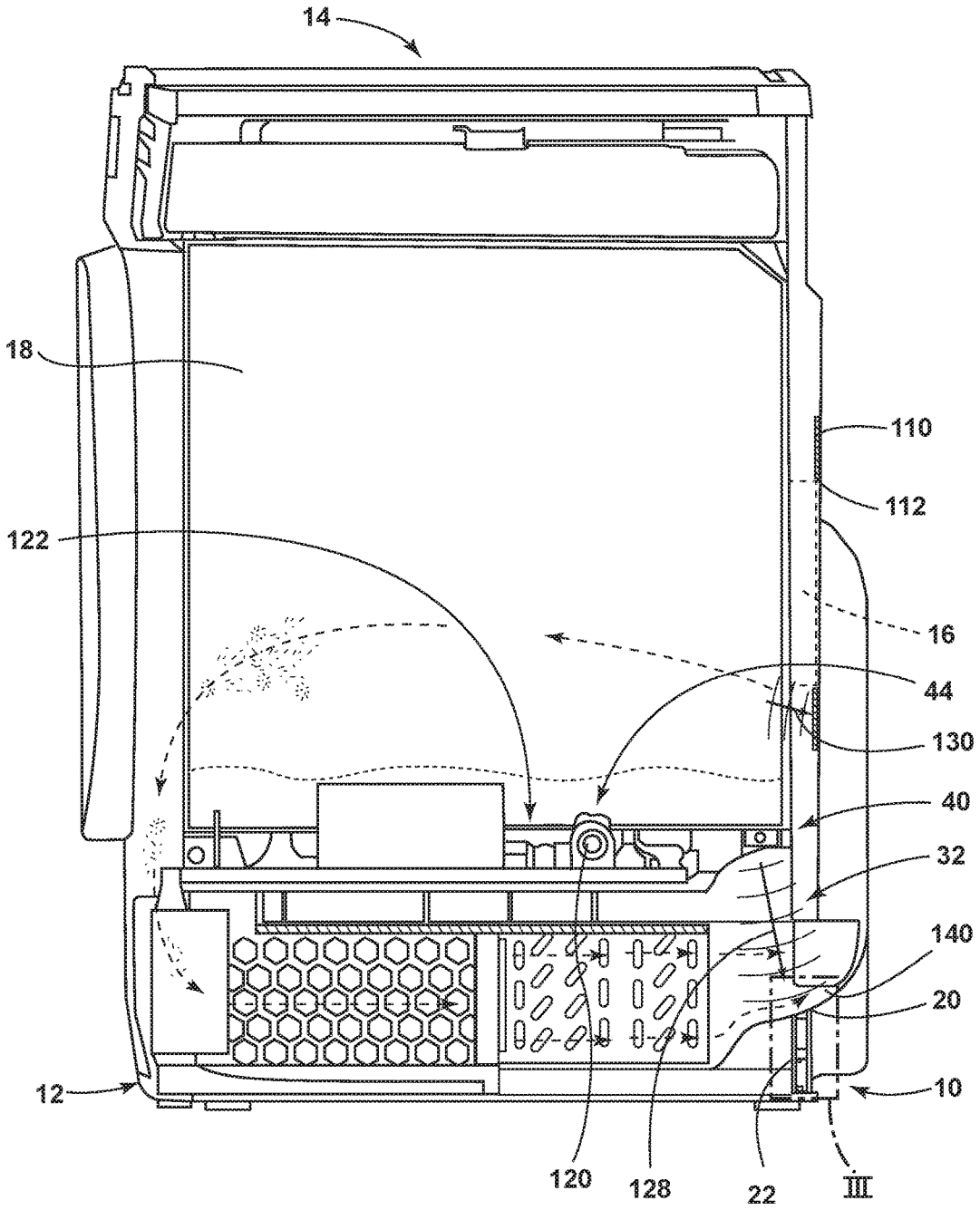
FIG. 2 is a cross-sectional view of the laundry appliance of FIG. 1, taken along line II-II.
Figure 3:
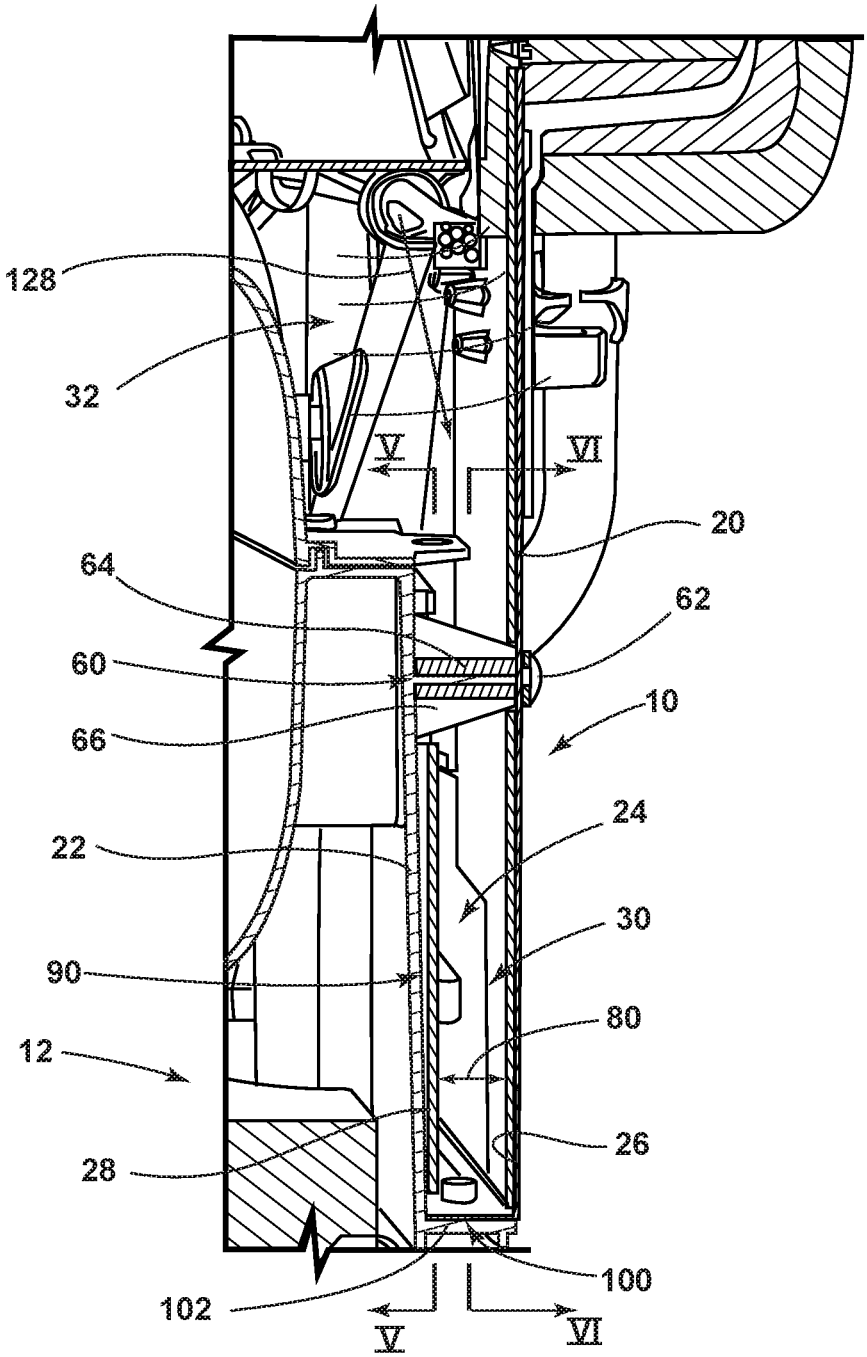
FIG. 3 is an enlarged cross-sectional view of the laundry appliance of FIG. 2 taken at area III.
Figure 4:
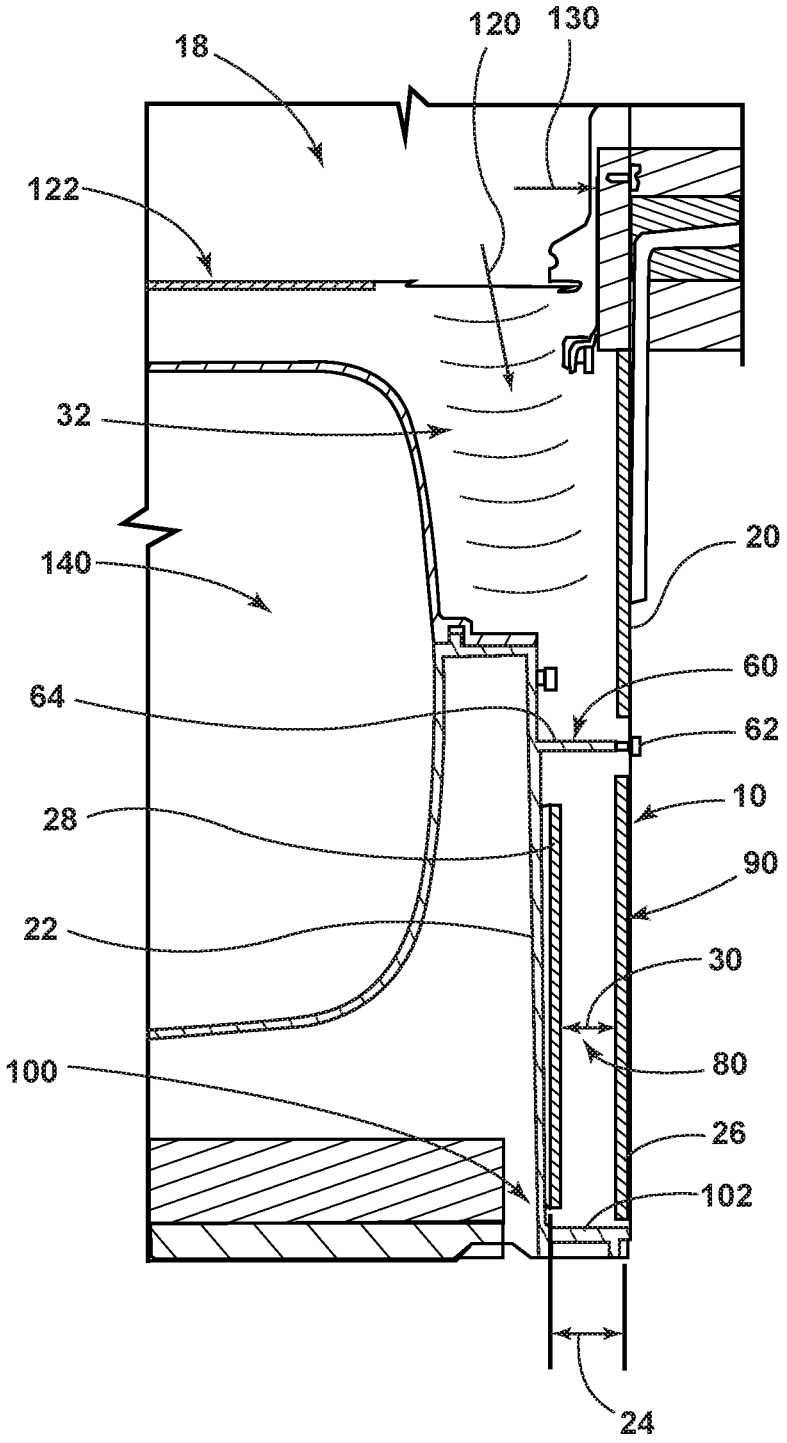
FIG. 4 is a schematic cross-sectional view of a basement for a laundry appliance incorporating an aspect of the acoustical damping structure.
Figure 5:
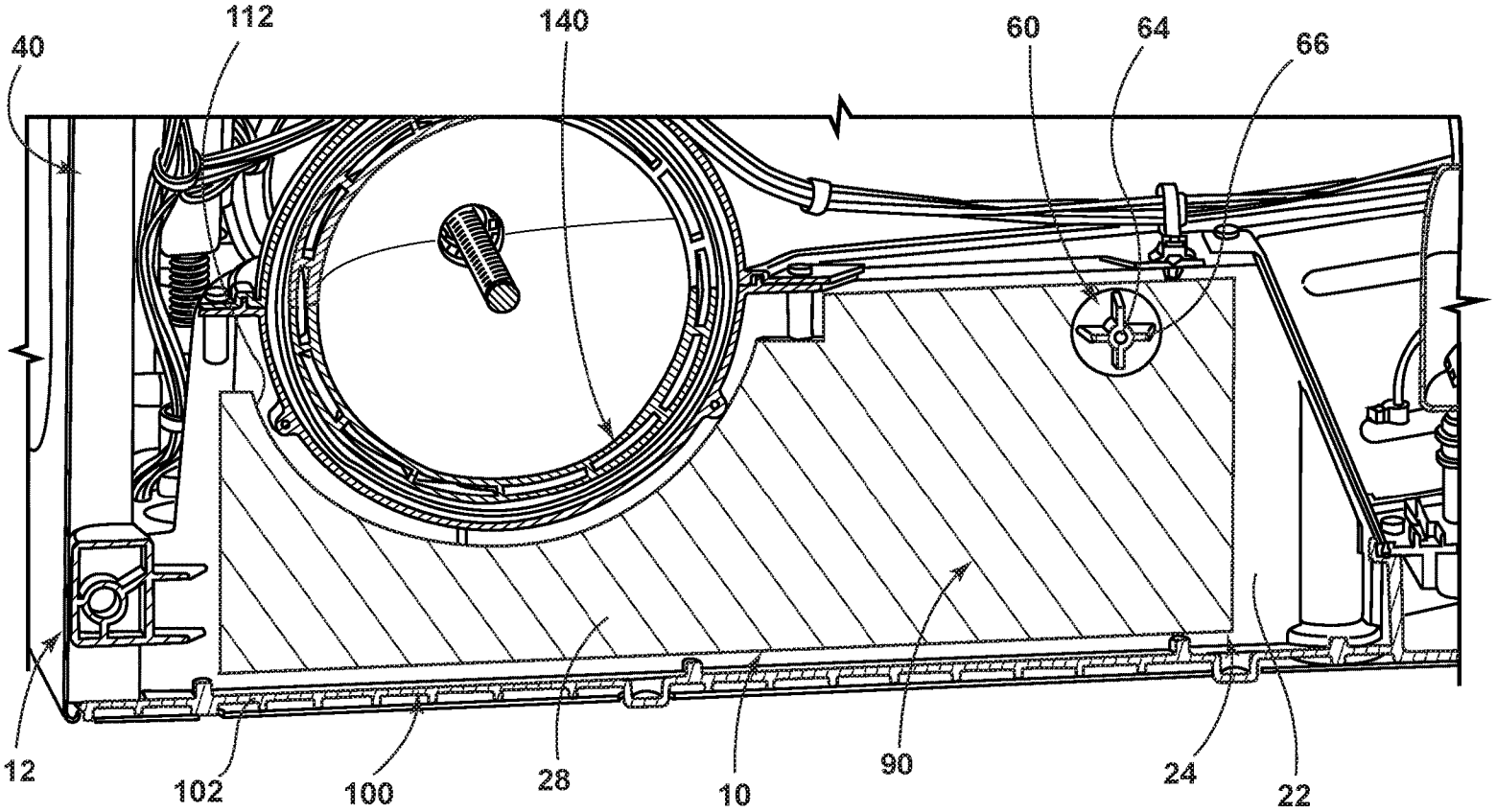
FIG. 5 is a cross-sectional view of the laundry appliance of FIG. 4 taken at line V-V and showing a first insulation member attached to a rear wall of the appliance.
Figure 6:
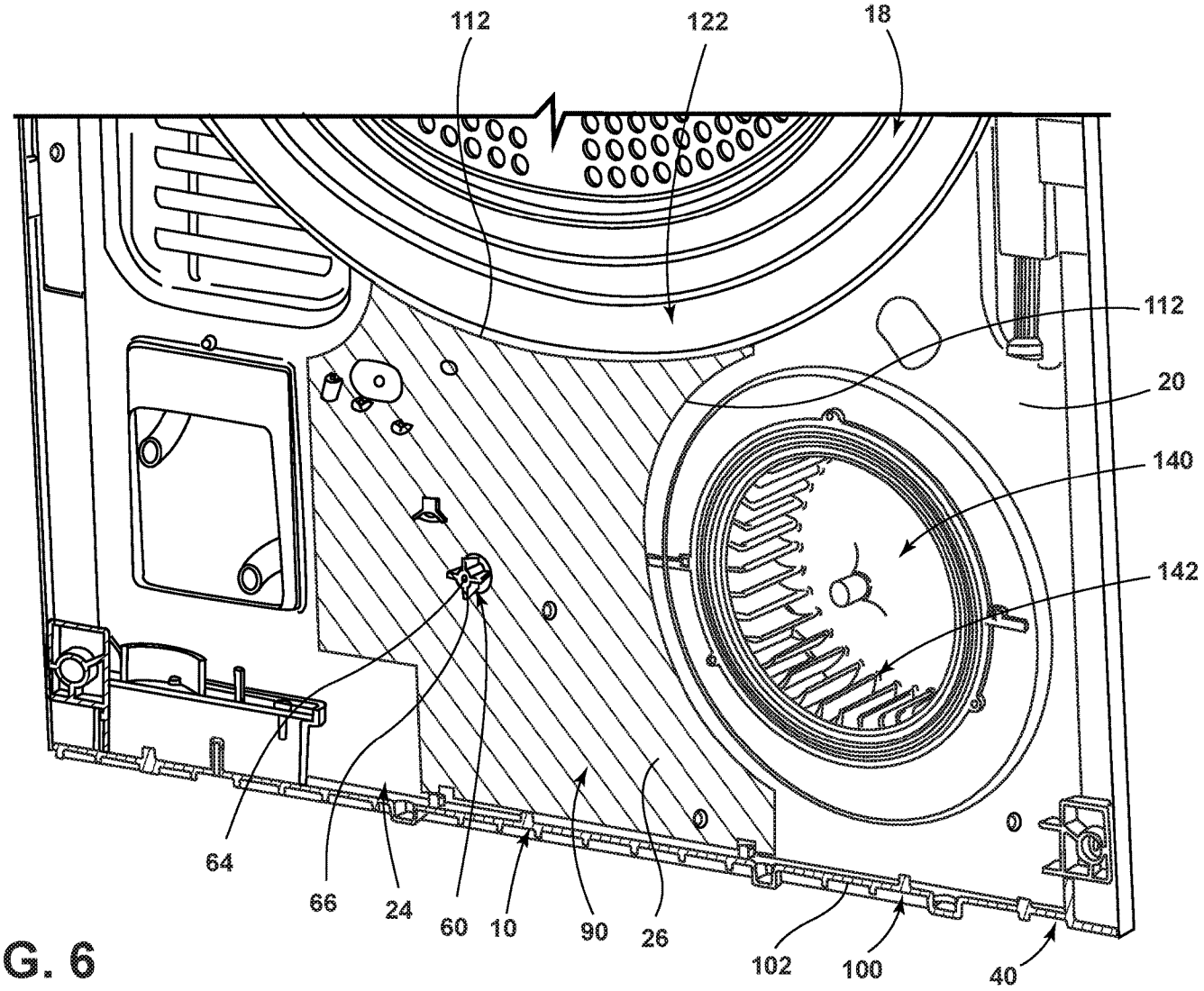
FIG. 6 is a cross-sectional view of the laundry appliance of FIG. 5 taken at line VI-VI and showing a second insulation member attached to an interior wall of a base pan included within the basement of the laundry appliance.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As exemplified in FIGS. 1-6, reference numeral 10 generally refers to an acoustical damping structure that is located within a basement 12 of a laundry appliance 14. The acoustical damping structure 10 is typically attached to one or more structural walls within the basement 12 of the laundry appliance 14. According to various aspects of the device, the laundry appliance 14 can include a motor 16 that operates a rotating drum 18 for processing laundry. A rear wall 20 of a cabinet 40 is located behind the rotating drum 18. An interior wall 22 is offset from the rear wall 20. The rear and interior walls 20, 22 cooperate to define a cavity 24 therebetween. First and second insulating members 26, 28 of the acoustical damping structure 10 are positioned in an offset configuration within the cavity 24. The first insulating member 26 can be attached to the rear wall 20 and the second insulating member 28 can be attached to the interior wall 22. Accordingly, a gap 30 is defined between the first and second insulating members 26, 28. The gap 30 and the first and second insulating members 26, 28 of the acoustical damping structure 10 cooperate to absorb vibrations 32 that may be generated by the rotating drum 18 of the laundry appliance 14 and during operation of the motor 16.

During operation of the laundry appliance 14, the motor 16 operates the drum 18 within the cabinet 40 to process laundry therein. The laundry may be processed using various laundry cycles that can include, but are not limited to, washing, drying, rinsing, soaking, combinations thereof, and other similar laundry processing functions. As the motor 16 rotates the drum 18, the drum 18 and the motor 16 may generate various vibrations 32 and noises as they rotate within the structure of the cabinet 40. These vibrations 32 and other noises can be generated as the drum 18 for the laundry appliance 14 rotates within various guide members 44 and bearing mechanisms can also be used to guide the rotation of the drum 18 within the cabinet 40. The engagement of the drum 18 with these guide members 44 can also generate various vibrations 32 and noises during operation of the appliance 14. These vibrations 32 and noises can be absorbed through placement of the acoustical damping structure 10 within a rear portion of the appliance 14.

Referring again to FIGS. 1-6, the first and second insulating members 26, 28 of the acoustical damping structure 10 are typically oriented in a parallel configuration within the cavity 24 that is defined between the rear wall 20 and the interior wall 22. To assist in maintaining the placement and configuration of the first and second insulating members 26, 28 and also the placement of the rear and interior walls 20, 22, an interior support 60 can extend through the cavity 24 and between the rear wall 20 and the interior wall 22. This interior support 60 can include a fastener 62 that extends through the rear wall 20 and engages a receptacle 64 that spans the cavity 24 between the interior wall 22 and the rear wall 20. This receptacle 64 can include a plurality of support flanges 66 that extend between the rear wall 20 and the interior wall 22. The support flanges 66 and the receptacle 64 are configured to reinforce the positioning of the rear wall 20 and the interior wall 22 with respect to one another.

In various aspects of the device, the receptacle 64 can extend through a portion of the rear wall 20 to receive the fastener 62. In such an embodiment, the fastener 62 serves to secure the rear wall 20 to the receptacle 64, and the receptacle 64 and the support flanges 66 are coupled with the interior wall 22. In this manner, the interior support 60 extends through each of the first and second insulating members 26, 28 and assists in maintaining the first and second insulating members 26, 28 in a parallel configuration within the cavity 24.

Referring again to FIGS. 3 and 4, the gap 30 that is defined between the first and second insulating members 26, 28 assists in absorbing various vibrations 32 and noise that may be generated through operation of the motor 16 and/or the rotating drum 18 for the appliance 14. This gap 30 may have various thicknesses depending upon the design of the appliance 14. In at least one aspect of the device, the gap 30 can have a gap thickness 80 of approximately 15 millimeters. Again, this gap thickness 80 is maintained at least partially through the incorporation of the interior support 60 that extends between the interior wall 22 and the rear wall 20 and also extends through the first and second insulating members 26, 28. The motor 16 for the appliance 14 can be a direct drive motor. The motor 16 can also be a belt drive motor.

The first and second insulating members 26, 28 can be made of various insulating materials that can be used to absorb vibration 32 and noises generated by the motor 16 and the rotating drum 18. One such insulating material 90 can include damping asphalt sheets that are attached to the interior wall 22 and the rear wall 20 within the cavity 24 defined therebetween. The damping asphalt sheets serve as insulating material 90 that receives and at least partially absorbs various frequencies and vibrations 32 before they can be directed out of the appliance 14. In various aspects of the device, other insulating materials 90 can include, but are not limited to, batting, foam insulation, fibrous insulating material, insulating panels, a combination thereof, and other similar insulating materials.

Referring again to FIGS. 3 and 4, the interior wall 22 can be incorporated as part of a base pan 100 for the appliance 14. The base pan 100 can include a horizontal member 102 that extends under at least a portion of the rear wall 20. Accordingly, the rear wall 20 can extend over and may be partially supported by a horizontal member 102 of the base pan 100 from below. The base pan 100 can include the interior wall 22 that extends vertically from the horizontal member 102. In various aspects, the base pan 100 and the interior wall 22 can be integrally formed as a single structural member included within the basement 12 for the appliance 14. The interior wall 22 and the horizontal member 102 of the base pan 100 may also be separate members that are attached together to from the structure of the base pan 100.

Referring again to FIGS. 2-6, the acoustical damping structure 10 can also include an upper insulating member 110 that is typically positioned on a rear surface of the rear wall 20 near the rotating drum 18. The upper insulating member 110 can also be positioned inside the cabinet 40. In such an embodiment, the upper insulating member 110 may include a recess 112 that at least partially encircles the motor 16 for the rotating drum 18. Through the various configurations, vibration 32 and sound that may be generated by the operation of the motor 16 and the rotating drum 18 can be at least partially absorbed by the upper insulating member 110 for the acoustical damping structure 10.

During operation of the appliance 14, the drum 18 rests upon a support structure 120. The support structure 120 is typically located near the lower portion 122 of the drum 18 and engagement of the drum 18 with the support structure 120 causes vibration 32 and noise around this lower portion 122 of the drum 18. During operation of the motor 16 that rotates the drum 18, various vibrations 32 and noises can be directed in a generally downward direction 128 and toward the cavity 24 defined between the interior wall 22 and the rear wall 20. The placement of the acoustical damping structure 10 is intended to intercept and at least partially absorb these vibrations 32 and noises emanating from the lower portions 122 of the drum 18. By placing the first and second insulating members 26, 28 within the cavity 24, a substantial portion of the vibration 32 and noises emanating from the drum 18 can be absorbed within the acoustical damping structure 10 for the appliance 14.

Referring again to FIGS. 1-6, the laundry appliance 14 can include the base pan 100 and the rear wall 20 that are connected to partially form an appliance cabinet 40. The motor 16 for operating the rotating drum 18 within the appliance cabinet 40 can be coupled proximate the rear wall 20. The first insulating member 26 of the acoustical damping structure 10 can be attached to the rear wall 20. The second insulating member 28 of the acoustical damping structure 10 is attached to a vertical portion of the base pan 100. In this manner, the first and second insulating members 26, 28 form a gap 30 that is defined therebetween. The gap 30 and the first and second insulating members 26, 28 cooperate to form the acoustical damping structure 10 that serves to absorb various vibrations 32 generated by the rotating drum 18 during operation of the motor 16. As discussed above, the interior support 60 that extends between the interior wall 22 and the rear wall 20 also extends through each of the first and second insulating members 26, 28. In this manner, the interior support 60 maintains the gap 30 defined between the first and second insulating members 26, 28 and also places the first and second insulating members 26, 28 in the parallel configuration within the cavity 24.

Referring again to FIGS. 2-4, the upper insulating member 110 that is positioned on the rear wall 20 near the rotating drum 18 and the motor 16 serves to absorb vibration 32 and noise from the rotating drum 18. Certain amount of the vibration 32 and noise emanating from the drum 18 can be directed in a rearward direction 130 and toward the rear wall 20 near the motor 16. The upper insulating member 110 serves to intercept these vibrations 32 and absorb them within the upper insulating member 110. To assist in absorbing these vibrations 32 from the drum 18, the upper insulating member 110 can include a recess 112 that at least partially encircles the motor 16 for driving the rotating drum 18. Accordingly, vibrations 32 emanating from the drum 18 are substantially prevented from passing around the motor 16 and outside of the cabinet 40. The upper insulating member 110 can also be configured to extend around a portion of the motor 16. In such an embodiment, the recess 112 of the upper insulating member 110 can be positioned within an edge of the upper insulating member 110.

In various aspects of the device, the recess 112 that at least partially extends around the motor 16 can also be defined within one or both of the first and second insulating members 26, 28. In such an embodiment, the first insulating member 26 can extend upward along the rear wall 20 so that the first insulating member 26 can include the recess 112. In this manner, the first insulating member 26 may form at least a portion of the upper insulating member 110. The remainder of the upper insulating member 110 may also include a separate piece that extends around a separate portion of the motor 16.

As exemplified in FIGS. 1-6, the base pan 100 and rear wall 20 are connected together to partially form a cavity 24 within the cabinet 40 for the appliance 14. The motor 16 for operating the rotating drum 18 is disposed within the cabinet 40 for the appliance 14. The first and second insulating members 26, 28 for the acoustical damping structure 10 are positioned within the cavity 24 and also define the gap 30 therebetween. The upper insulating member 110 is typically positioned on the rear wall 20 near the rotating drum 18 and/or the motor 16 that operates the rotating drum 18. Typically, the upper insulating member 110 will be attached to the outside surface of the rear wall 20. In such an embodiment, the upper insulating member 110 may be exposed and visible. The upper insulating member 110 may also be disposed on an inside surface of the rear wall 20 between the rear wall 20 and the rotating drum 18. The upper insulating member 110, the first and second insulating members 26, 28 and the gap 30 defined between the first and second insulating members 26, 28 cooperates to absorb vibrations 32 and noise that may be generated by the rotating drum 18 during operation of the motor 16. As discussed above, the interior support 60 extends through the cavity 24 and between the rear wall 20 and the base pan 100. The interior support 60 also extends through each of the first and second insulating members 26, 28 and maintains the gap 30 defined therebetween. The interior support 60 also sets the spacing and maintains the position of the first and second insulating members 26, 28.

While the configuration of the first and second insulating members 26, 28 may be parallel, nonparallel configurations can also be used depending upon the design of the basement 12 for the appliance 14. Where the interior wall 22 and the rear wall 20 are set in a nonparallel configuration, the first and second insulating members 26, 28 will typically match this nonparallel configuration.

In various aspects of the device, additional insulating members can be disposed within the cavity 24 defined between the interior wall 22 and the rear wall 20 for the cabinet 40. Additional intermediary insulating members can be positioned to absorb additional vibrations 32 and frequencies of sound that may be generated through operation of the drum 18 within the cabinet 40. It is also contemplated that the first and second insulating members 26, 28 may be disposed near an air-flow path 140 for the appliance 14. Such an air-flow path 140 for the appliance 14 may allow for the movement of heated air therethrough. Accordingly, at least one of the first and second insulating members 26, 28 may typically be made of a heat-resistant material that can resist deformation or other damage that may be caused by the heated process air moving through the air-flow path 140 for the appliance 14.

The insulating material 90 may also be at least partially water resistant. During operation of the appliance 14, moisture is removed from a load of laundry being processed within the drum 18. Various amounts of this moisture can be moved through the air-flow path 140 and may, in various conditions, infiltrate into portions of the appliance 14 outside of the air-flow path 140, including the cavity 24. The first and second insulating members 26, 28 are typically water resistant such that any moisture that may infiltrate into the cavity 24 can be repelled from the first and second insulating members 26, 28. Accordingly, the first and second insulating members 26, 28 are substantially resistant to damage that may be caused by moisture that may enter the cavity 24 during operation of the appliance 14.

The first and second insulating members 26, 28 can also include one or more recesses 112 that can extend around portions of the air-flow path 140. In such an embodiment, a portion of the first and second insulating members 26, 28 can include a recess 112 that extends around a portion of the blower 142 or a portion of the ductwork that forms the air-flow path 140. The first and second insulating members 26, 28 can also include recesses 112 that extends around the drum 18 or another portion of the appliance 14.

In various aspects of the device, it is contemplated that the acoustical damping structure 10 can be included within various laundry appliances. Such laundry appliances can include, but are not limited to, vertical-axis laundry appliances, horizontal-axis laundry appliances, heat pump appliances, appliances having resistive heating elements for heating processed air, combination washing and drying appliances, appliances that include both a heat pump system and a resistive heater, combinations thereof, and other similar laundry appliances.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A laundry appliance comprising:

a motor that operates a rotating drum for processing laundry;

a rear wall of a cabinet that is located behind the rotating drum;

an interior wall that is offset from the rear wall and that defines a cavity therebetween; and first and second insulating members that are positioned apart from one another in an offset configuration within the cavity, wherein an interior support extends through the cavity and between the rear wall and the interior wall, and wherein the interior support extends through each of the first and second insulating members and maintains the first and second insulating members in a parallel configuration within the cavity, wherein the first insulating member is attached to the rear wall and the second insulting member is attached to the interior wall.

2. The laundry appliance of claim 1, wherein the first and second insulating members are oriented in a parallel configuration within the cavity.

3. The laundry appliance of claim 1, wherein a gap is defined between the first and second insulating members, and wherein the gap and the first and second insulating members cooperate to absorb vibrations generated by the rotating drum during operation of the motor.

4. The laundry appliance of claim 3, wherein the gap has a thickness of approximately 15 millimeters.

5. The laundry appliance of claim 1, wherein the interior wall is coupled to a base pan, wherein the base pan at least partially supports the rear wall from below.

6. The laundry appliance of claim 5, wherein the base pan and the interior wall are integrally formed as a single structural member.

7. The laundry appliance of claim 1, further comprising:

an upper insulating member that is positioned on the rear wall near the motor for the rotating drum.

8. The laundry appliance of claim 1, wherein the first and second insulating members are damping asphalt sheets.

9. A laundry appliance comprising:

a base pan and a rear wall that are connected to partially form an appliance cabinet;

a motor that rotates a drum within the appliance cabinet;

a first insulating member that is attached to the rear wall; and a second insulating member that is attached to a vertical portion of the base pan; wherein the first and second insulating members define a gap therebetween;

the gap and the first and second insulating members cooperate to absorb vibrations generated by the drum during operation of the motor;

an interior support extends through the gap and between the rear wall and the vertical portion of the base pan; and the interior support extends through each of the first and second insulating members and maintains the first and second insulating members in a parallel configuration.

10. The laundry appliance of claim 9, wherein the gap has a thickness of approximately 15 millimeters.

11. The laundry appliance of claim 9, further comprising:

an upper insulating member that is positioned on the rear wall near the drum, wherein the upper insulating member includes a recess that at least partially encircles the motor for the rotating drum.

12. A laundry appliance comprising:

a base pan and a rear wall that are connected to partially form a cavity within an appliance cabinet;

a motor that operates a rotating drum within the appliance cabinet;

first and second insulating members that are positioned within the cavity and define a gap therebetween, the first and second insulating members attached to the rear wall and a vertical portion of the base pan, respectively;

an interior support that extends through the cavity and between the rear wall and the vertical portion of the base pan, and wherein the interior support extends through each of the first and second insulating members and maintains the first and second insulating members in a parallel configuration; and an upper insulating member that is positioned on the rear wall near the rotating drum, wherein the upper insulating member and the first and second insulating members cooperate to absorb vibrations generated by the rotating drum during operation of the motor.

13. The laundry appliance of claim 12, wherein the upper insulating member includes a recess that at least partially encircles the motor for the rotating drum.

14. The laundry appliance of claim 12, wherein the first and second insulating members at least partially engage a blower that directs process air through the rotating drum.

* * * * *